US010602812B2

(12) United States Patent
Gordon

(10) Patent No.: US 10,602,812 B2
(45) Date of Patent: Mar. 31, 2020

(54) SLIDE FASTENER REINFORCEMENT STRAP

(71) Applicant: YKK Corporation, Tokyo (JP)

(72) Inventor: John Gordon, Whalley (GB)

(73) Assignee: YKK Corporation (JP)

( * ) Notice: Subject to any disclaimer, the term of this patent is extended or adjusted under 35 U.S.C. 154(b) by 0 days.

(21) Appl. No.: 15/750,903

(22) PCT Filed: Aug. 16, 2016

(86) PCT No.: PCT/JP2016/073921
§ 371 (c)(1),
(2) Date: Feb. 7, 2018

(87) PCT Pub. No.: WO2017/030123
PCT Pub. Date: Feb. 23, 2017

(65) Prior Publication Data

US 2018/0235324 A1 Aug. 23, 2018

(30) Foreign Application Priority Data

Aug. 18, 2016 (GB) ..... 1514682.2

(51) Int. Cl.
*A44B 19/36* (2006.01)
*A44B 19/02* (2006.01)
*A44B 19/32* (2006.01)
*A44B 19/60* (2006.01)

(52) U.S. Cl.
CPC ..... *A44B 19/36* (2013.01); *A44B 19/02* (2013.01); *A44B 19/32* (2013.01); *A44B 19/60* (2013.01)

(58) Field of Classification Search
CPC ..... A44B 19/02; A44B 19/32; A44B 19/36; A44B 19/60
See application file for complete search history.

(56) References Cited

U.S. PATENT DOCUMENTS 2,259,495 A * 10/1941 Soave ..... A41H 37/003 24/390
2,267,119 A * 12/1941 Marinsky ..... A44B 19/36 2/234

(Continued)

FOREIGN PATENT DOCUMENTS

GB 1417714 A 12/1975
WO 2015/097864 A1 7/2015

OTHER PUBLICATIONS

International Preliminary Report on Patentability, PCT Patent Application No. PCT/JP2016/073921, dated Feb. 20, 2018.

(Continued)

*Primary Examiner* — Robert Sandy
*Assistant Examiner* — David M Upchurch
(74) *Attorney, Agent, or Firm* — Kilpatrick Townsend & Stockton LLP

(57) ABSTRACT

A slide fastener reinforcing strap for securing across an opening formed between first and second tapes of a slide fastener is provided. The slide fastener reinforcing strap extends from a first end to a second end along a centerline. The slide fastener reinforcing strap includes a first protrusion between the first and second ends. The first protrusion extends in a first direction which is perpendicular to the centreline.

20 Claims, 11 Drawing Sheets

(56) References Cited

U.S. PATENT DOCUMENTS

| | | | | | |
|---|---|---|---|---|---|
| 2,321,926 | A * | 6/1943 | Marinsky | A44B 19/301 | 24/384 |
| 2,989,802 | A * | 6/1961 | McNamara | A44B 19/28 | 2/234 |
| 3,077,847 | A * | 2/1963 | Morin | A44B 19/36 | 112/475.16 |
| 3,348,509 | A | 10/1967 | Degraw | | |
| 3,512,225 | A * | 5/1970 | Halstead | A44B 13/00 | 24/381 |
| 3,555,627 | A * | 1/1971 | Howell | A41H 37/06 | 112/475.16 |
| 3,849,841 | A * | 11/1974 | Borzner, Jr. | A44B 19/36 | 24/435 |
| 3,953,912 | A * | 5/1976 | Fukuroi | A44B 19/36 | 24/383 |
| 4,829,603 | A * | 5/1989 | Schnoor | A41D 13/02 | 2/69 |
| 6,112,383 | A | 9/2000 | Salam | | |
| 2007/0251063 | A1* | 11/2007 | Kusayama | A44B 19/32 | 24/381 |

OTHER PUBLICATIONS

International Search Report, PCT Patent Application No. PCT/JP2016/073921, dated Oct. 11, 2016.
Written Opinion, PCT Patent Application No. PCT/JP2016/073921, dated Oct. 11, 2016.

* cited by examiner

SLIDE FASTENER REINFORCEMENT STRAP

TECHNICAL FIELD

The present invention relates to a slide fastener reinforcing strap, and a slide fastener including a slide fastener reinforcing strap.

BACKGROUND ART

Known slide fasteners (also referred to as zip fasteners) are generally constructed as follows.

A coupling portion, usually in the form of a plurality of coupling elements (also referred to as teeth) is fixed to the edge of a tape to form a stringer. The tape is usually woven or knitted and may be formed from, for example, polyester. The coupling elements may be fixed to the tape by, for example, crimping or moulding the coupling elements onto a reinforced edge of the tape. Alternatively, the coupling elements may be formed as a continuous coil having a coil-like shape formed by winding a monofilament made of synthetic resin. In this case the coupling elements are most commonly fixed to the edge of the tape while being woven or knitted into the tape or, alternatively, are stitched to a surface of the tape at the edge of the tape.

Two stringers are brought together, such that the coupling elements of each stringer can attach to one another, for example, by interdigitating, to form chain. The chain is generally planar, and the chain (and the coupling portions which form part of the chain) extends along a longitudinal axis of the chain. A slider is mounted to the chain such that it can move along the chain between the two stringers.

The slider commonly includes a main body through which the coupling elements of each stringer pass and a pull tab attached to the main body which may be grasped by a user in order to effect movement of the slider along the chain.

Movement of the slider along the chain in a first sliding direction causes the coupling elements of the first stringer to attach to the coupling elements of the second stringer. Whereas movement of the slider along the chain in a second sliding direction, opposite to the first sliding direction, causes the coupling elements of the first stringer to detach from the coupling elements of the second stringer.

The chain is cut to a desired length to form a desired length of slide fastener. End stops (often referred to as top stops and bottom stops) are attached to either end of the chain. The end stops limit the extent of movement that the slider can undertake along the chain.

Some slide fasteners, may have a single bottom stop which is attached to both the first and second stringers. Other slide fasteners, which may be referred to as a separating slide fasteners, may have two separate bottom stops respectively fixed to the first and second stringers. The two bottom stops may take the form of a retainer box and an insertion pin. The insertion pin can be inserted into the retainer box in order to attach the first and second stringers to one another. Conversely, the insertion pin can be removed from the retainer box in order to detach the first and second stringers from one another.

The invention discussed in more detail below is of most use in combination with a slide fastener of the type which has a single bottom stop.

Some slide fasteners may have two separate top stops respectively fixed to the first and second stringers. Other slide fasteners may have a single top stop attached to both of the first and second stringers.

In situations in which a slide fastener includes a single bottom stop and/or a single top stop, if significant force is applied to one of the stringers (particularly in a direction perpendicular to the sliding directions of the slider) this may cause the stringers to become detached at the bottom and/or top stop of the stringers, resulting in damage to the slide fastener and potentially resulting in the slide fastener becoming inoperable. This may occur, for example, when the slide fastener forms part of an entry opening for a dry suit via which a user puts on or takes off the dry suit. For example, when putting on the dry suit, a user may inadvertently step on one of the stringers, causing it to be urged away from the other stringer.

In order to address this problem, it is known (see, for example, Patent Document 1) to provide the slide fastener with a reinforcing strap which extends between the first and second stringers at a location proximate to the bottom stop and/or top stop as appropriate. In this situation, if significant force is applied to one of the stringers then the force is absorbed by the reinforcing strap, which prevents the stringers from being urged apart at the bottom stop and/or top stop, thereby preventing damage to the slide fastener.

Some applications of slide fastener require that the slide fastener is bent about an axis which is perpendicular to both the longitudinal axis (i.e., an axis extending in a longitudinal direction of the chain) of the chain and the perpendicular to the plane of the chain. This may happen, for example, when a slide fastener forms part of a dry suit. The slide fastener may pass over a hip and/or a shoulder of a wearer of a dry suit, this resulting in the aforementioned bending. For example, the slide fastener may pass entirely over the shoulder, even passing from the front of the drysuit onto the back. In some cases bending a slide fastener which includes a reinforcing strap whilst sliding the slider along the slide fastener may result in the reinforcing strap snagging on the slider. This in turn may result in the slider tearing the reinforcing strap and/or in the coupling elements of least one of the stringers separating from the slider rendering the slide fastener inoperable.

Furthermore, some articles which include a slide fastener with a reinforcing strap may be tight fitting, for example a dress. In such situations, whilst the article is being used, the reinforcing strap may be pushed into the coupling elements and/or slider such that, again, the reinforcing strap may snag on the slider whilst sliding the slider along the slide fastener.

Some known slide fasteners are watertight such that, in use, when the slide fastener is in a closed configuration, water is substantially prevented from passing through the slide fastener. Such slide fasteners may form part of an article which is designed to be substantially watertight, such as a dry suit. Due to the greater extent to which the coupling elements have to couple with one another within a watertight slide fastener in order to make the slide fastener watertight, it is common for watertight slide fasteners to require more force to slide the slider as compared to a standard slide fastener. The requirement for using additional force to operate a watertight slide fastener may exacerbate the problems discussed above in relation to slide fasteners including a reinforcing strap.

PRIOR ART DOCUMENT

Patent Document

Patent Document 1: United Kingdom Patent No. GB 1417714

SUMMARY OF INVENTION

Problems to be Solved by Invention

It is an object of the present invention to provide a reinforcing strap and a slide fastener which obviate or ameliorate the problems discussed above. It is a further object of the invention to provide an alternative reinforcing strap and slide fastener.

Means for Solving Problems

According to a first aspect of the present invention, there is provided a slide fastener reinforcing strap for securing across an opening formed between first and second tapes of a slide fastener, the slide fastener reinforcing strap extending from a first end to a second end along a centreline, the slide fastener reinforcing strap including a first protrusion between the first and second ends, the protrusion extending in a first direction which is perpendicular to the centreline.

The first protrusion acts so as to substantially prevent the slide fastener reinforcing strap from snagging on a slider of a slide fastener which is used in conjunction with a slide fastener reinforcing strap according to this aspect of the invention.

The centreline may also be referred to as a longitudinal axis of the slide fastener reinforcing strap. The first protrusion may extend away from the centreline proximate the first protrusion—i.e. the portion of the centreline adjacent the first protrusion.

The slide fastener reinforcing strap may further comprise a second protrusion which extends in a second direction which is perpendicular to the centreline and which is generally opposite to the first direction.

The second protrusion may extend away from the centreline proximate the second protrusion—i.e. the portion of the centreline adjacent the second protrusion.

The slide fastener reinforcing strap may be generally planar such that it lies in a first plane.

The first direction may generally lie within the first plane.

The second direction may generally lie within the first plane.

The slide fastener reinforcing strap may be formed from a flexible material.

The reinforcing strap may comprise two pre-folds configured to enable the reinforcing strap to be preferentially folded so that the strap substantially forms the shape of a letter U.

According to a second aspect of the invention there is provided a slide fastener and a slide fastener reinforcing strap according to the first aspect of the invention, wherein the slide fastener includes first and second fastener tapes and a slider, each fastener tape including a coupling portion provided along an edge of the fastener tape, the coupling portions of the fastener tapes being located adjacent one another, the coupling portions of the first and second fastener tapes being received by the slider, wherein the slider is configured such that movement of the slider relative to the fastener tapes in a first sliding direction draws the coupling portions into securing engagement with one another, and such that movement of the slider relative to the fastener tapes in a second sliding direction, generally opposite to the first sliding direction, separates the coupling portions from each other, and wherein the slide fastener reinforcing strap is attached to the first and second fastener tapes.

The slide fastener reinforcing strap may be orientated relative to the slide fastener such that the first direction in which the first protrusion extends away from the centreline is the same direction as the second sliding direction.

The slide fastener reinforcing strap may be orientated relative to the slide fastener such that the first direction in which the first protrusion extends away from the centreline is the same direction as the first sliding direction.

The slide fastener reinforcing strap may be folded back on itself such that the centreline forms a U-shape. As such, the slide fastener reinforcing strap may also be said to generally form a U-shape.

The slide fastener reinforcing strap may be orientated relative to the slide fastener such that the centreline at the first and second ends of the slide fastener reinforcing strap is parallel to the first and second sliding directions and such that the centreline in the region of the first protrusion is perpendicular to the first and second sliding directions.

The slider may comprise an upper portion connected to a lower portion by a connection post extending in a third direction from the upper portion to the lower portion; the upper portion, lower portion and connection post may co-operate to define a Y-shaped channel having a first channel portion separated from a second channel portion by the connection post, and a third channel portion which adjoins the first and second channel portions. The coupling portion of the first fastener tape may be received by the first and third channel portions of the Y-shaped channel of the slider, and the coupling portion of the second fastener tape may be received by the second and third channel portions of the Y-shaped channel of the slider. The width of the first protrusion parallel to the centreline and proximate the centreline may be greater than the width of an entrance to the first channel portion of the Y-shaped channel and/or than the width of an entrance to the second channel portion of the Y-shaped channel. The width of the entrance to the first channel portion and the width of the entrance to second channel portion may be in a direction which is substantially parallel to the centreline in the region of the protrusion.

The Y-shaped channel may also be defined by lateral flanges either side of the slider which extend towards each other from the upper portion and lower portion respectively.

The slider may comprise an upper portion connected to a lower portion by a connection post extending in a third direction from the upper portion to the lower portion. The upper portion, lower portion and connection post may co-operate to define a Y-shaped channel having a first channel portion separated from a second channel portion by the connection post, and a third channel portion which adjoins the first and second channel portions. The coupling portion of the first fastener tape may be received by the first and third channel portions of the Y-shaped channel of the slider, and the coupling portion of the second fastener tape may be received by the second and third channel portions of the Y-shaped channel of the slider. Entrances to each of the first and second channel portions may be located at a front end of the slider opposite a back end of the slider at which an entrance to the third channel portion is located. The first protrusion may extend away from a portion of the slider fastener reinforcing strap adjoining the first protrusion by a distance in the first direction which is greater than the distance between a forward-most tip of the lower portion and the forward-most point at which the connection post adjoins the upper portion.

The slider may comprise an upper portion connected to a lower portion by a connection post extending in a third direction from the upper portion to the lower portion. The upper portion, lower portion and connection post may cooperate to define a Y-shaped channel having a first channel portion separated from a second channel portion by the connection post, and a third channel portion which adjoins the first and second channel portions. The coupling portion of the first fastener tape may be received by the first and third channel portions of the Y-shaped channel of the slider, and the coupling portion of the second fastener tape may be received by the second and third channel portions of the Y-shaped channel of the slider. The first protrusion may extend away from a portion of the slider fastener reinforcing member adjoining the first protrusion by a distance in the first direction which is greater than half the distance in the third direction between the upper portion and the lower portion.

The first and second fastener tapes may be secured together by an end stop, the end stop limiting movement of the slider relative to the first and second fastener tapes in the first sliding direction or the second sliding direction.

The end stop may limit movement of the slider relative to the first and second fastener tapes in the first sliding direction. The slide fastener reinforcing strap may be located such that the slide fastener reinforcing strap overlaps the slider when the slider is positioned such that abuts the end stop. The portion of the reinforcing strap which overlaps the slider when the slider is positioned such that abuts the end stop may be a protrusion. The protrusion may be the first protrusion. The protrusion may be the second protrusion.

The slide fastener reinforcing strap may be located such that the second protrusion extends away from the centreline in the second direction by an amount sufficient to ensure that the second protrusion overlaps the slider when the slider is positioned such that abuts the end stop.

The slide fastener reinforcing strap may be located such that the second protrusion extends away from the centreline in the second direction by an amount sufficient to ensure, that when the slider is positioned such that abuts the end stop, the second protrusion overlaps the slider by a distance equal to about a third of the length of the slider parallel to the first sliding direction.

The end stop may limit movement of the slider relative to the first and second fastener tapes in the second sliding direction. The slide fastener reinforcing strap may be located such that the reinforcing strap overlaps the slider when the slider is positioned such that the slider abuts the end stop. The portion of the reinforcing strap which overlaps the slider when the slider is positioned such that abuts the end stop may be a protrusion. The protrusion may be the first protrusion. The protrusion may be the second protrusion. The slide fastener reinforcing strap may be located such that the first protrusion extends away from the centreline in the first direction by an amount sufficient to ensure that the first protrusion overlaps the slider when the slider is positioned such that the slider abuts the end stop. The slide fastener reinforcing strap may be located such that the second protrusion extends away from the centreline in the second direction by an amount sufficient to ensure that the second protrusion overlaps the slider when the slider is positioned such that the slider abuts the end stop.

The slide fastener may be a watertight slide fastener configured such that, in a closed configuration of the fastener, water is substantially prevented from passing through the slide fastener.

The first end of the slide fastener reinforcing strap may be attached to the first fastener tape and the second end of the slide fastener reinforcing strap may be attached to the second fastener tape.

According to a third aspect of the invention there is provided an article including a slide fastener according to the second aspect of the invention.

According to a fourth aspect of the invention there is provided an article including a slide fastener according to the first aspect of the invention, wherein the first end of the slide fastener reinforcing strap is attached to a first portion of the article, and the second end of the slide fastener reinforcing strap is attached to a second portion of the article, wherein the first fastener tape is located between the first portion of the article and the second fastener tape, and wherein the second fastener tape is located between the second portion of the article and the first fastener tape.

Other aspects and preferred features of the present invention will be apparent from the following description and the accompanying claims.

The invention will now be further described by way of example and with reference to the accompanying drawings

EMBODIMENTS OF INVENTION

Figure 1:
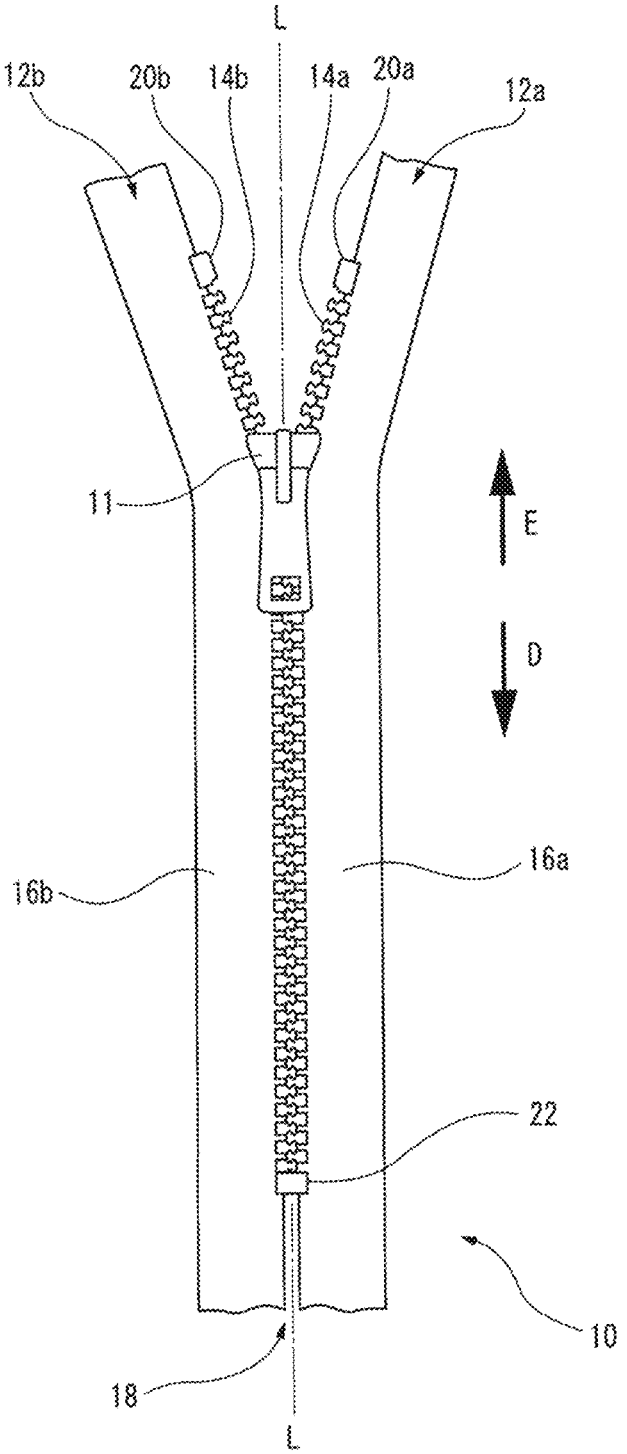
FIG. 1 is a schematic view of a known type of slide fastener including a slider.

FIG. 1 shows a known slide fastener 10. The slide fastener comprises a slider 11 and a pair of stringers 12*a*, 12*b*. Each stringer 12*a*, 12*b* comprises a coupling portion in the form of a plurality of coupling elements 14*a*, 14*b* which are attached to the edge of a tape 16*a*, 16*b*. The tape may be woven or knitted and may be formed from, for example, polyester. The coupling elements 14*a*, 14*b* may be attached to their respective tape 16*a*, 16*b* by, for example, crimping or moulding the coupling elements onto a reinforced edge of the tape 16*a*, 16*b*. Alternatively, the coupling elements may be formed as a continuous coil. In this case the coupling elements are most commonly woven or knitted into the tape or alternatively are stitched to a surface of the tape at the edge of the tape. In the case of a watertight slide fastener the tape may be coated with a waterproof film or extrudate and the coupling elements may be mounted to the tapes in a waterproof manner.

The two stringers 12*a*, 12*b* when brought together (as shown in the bottom portion of FIG. 1), are such that the coupling elements 14*a*, 14*b* of each stringer 12*a*, 12*b* can attach to one another, by interdigitating, to form chain 18. The chain 18 is generally planar, and the chain 18 (and the coupling portions which form part of the chain 18) extends along a longitudinal axis L of the chain 18.

The slider 11 is mounted to the chain 18 such that it can move along the chain 18 between the two stringers 12*a*, 12*b*. Movement of the slider 11 along the chain 18 in a first sliding direction E causes the coupling elements 14*a* of the first stringer 12*a* to attach to the coupling elements 14*b* of the second stringer 12*b*. Whereas movement of the slider along the chain in a second sliding direction D, opposite to the first sliding direction E, causes the coupling elements 14*a* of the first stringer 12*a* to detach from the coupling elements 14*b* of the second stringer 12*b*.

The chain 18 is commonly cut to a desired length to form a desired length of slide fastener 10. End stops (often referred to as top stops and bottom stops) are attached to either end of the chain 18. The end stops limit the extent of movement that the slider 11 can undertake along the chain 18.

In the slide fastener shown in FIG. 1, the top stops 20*a* and 20*b* are end stops attached to a top end of the chain 18 on the first tape 16*a* and second tape 16*b* respectively. Other slide fasteners may have a single top stop attached to both stringer tapes.

The slide fastener has a single bottom stop 22 which is attached to the tapes 16*a*, 16*b* of both the first and second stringers 12*a*, 12*b* and which secures the tape 16*a* and the tape 16*b* together.

Figure 2:
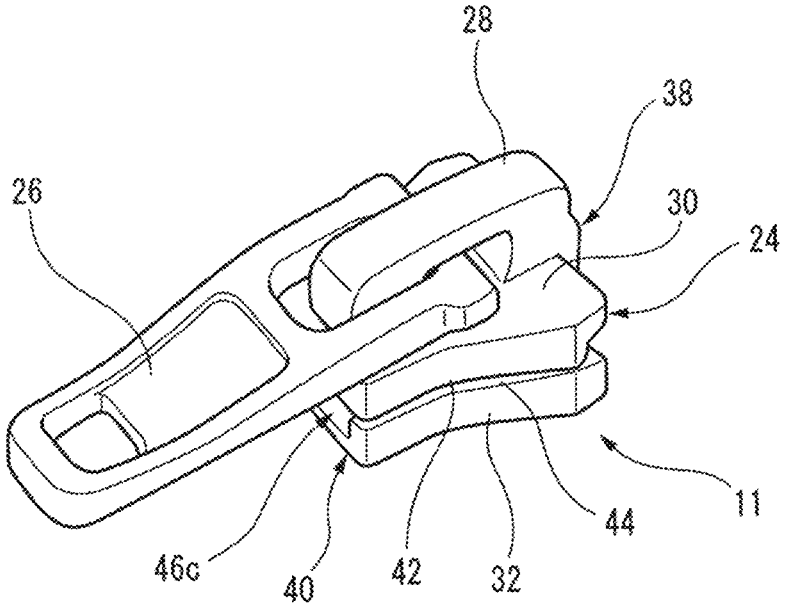
FIG. 2 is a schematic view of a known type of slider for a slide fastener of the type shown in FIG. 1.
Figure 3:
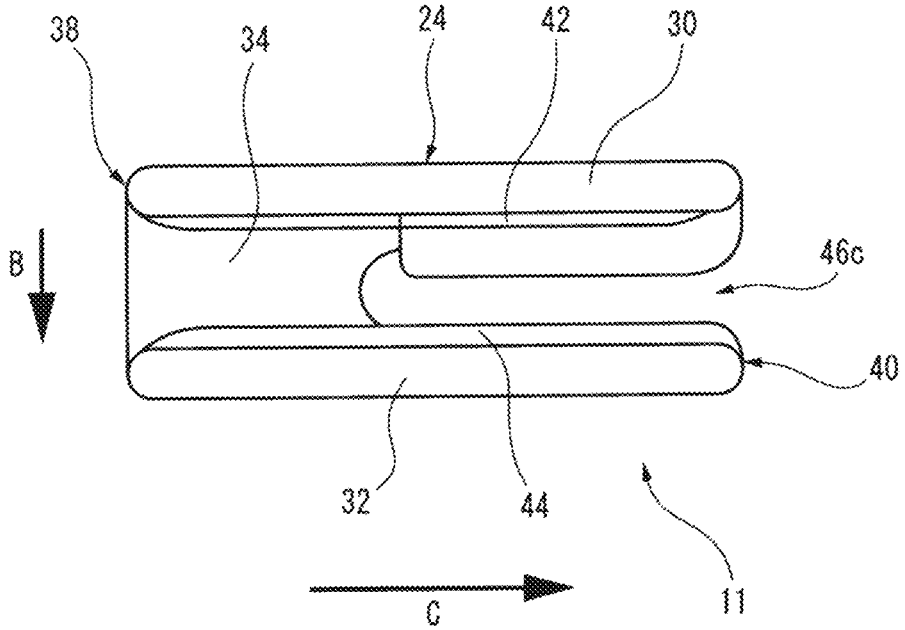
FIG. 3 is a schematic cross-sectional view of a portion of the slider shown in FIG. 2.
Figure 4:
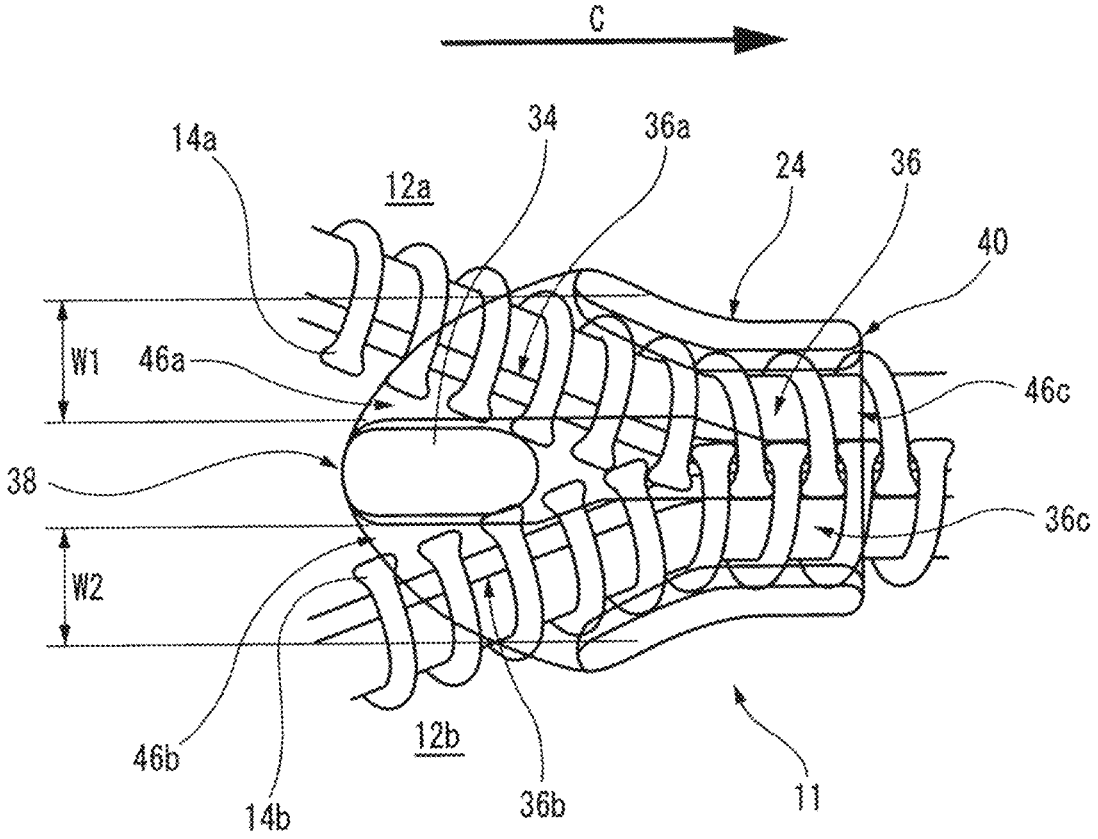
FIG. 4 is a schematic view of the slider of the slide fastener similar to that shown in FIG. 1 with the slider being transparent.

As seen in FIGS. 2, 3, and 4, the slider 11 includes a main body 24, through which the coupling elements 14*a*, 14*b* of each stringer 12*a*, 12*b* pass, and a pull tab 26 attached to the main body 24 via a bridge portion 28. The pull tab 26 may be grasped by a user in order to effect movement of the slider 11 along the chain 18 (for example, in the first and second sliding directions E, D previously discussed).

In more detail, the main body 24 of the slider 11 comprises an upper portion 30 connected to a lower portion 32 by a connection post 34 extending in a third direction B from the upper portion 30 to the lower portion 32. The upper portion 30 may be referred to as an upper wing or an upper blade. Likewise, the lower portion may be referred to as a lower wing or lower blade. The connection post 34 may be referred to as the diamond.

The upper portion 30, lower portion 32 and connection post 34 co-operate to define a Y-shaped channel 36. The Y-shaped channel 36 is also defined by a lateral flange 42 and a lateral 44 either side of the slider 11 which extend towards each other from the upper portion 30 and lower portion 32 respectively. The Y-shaped channel 36 has a first channel portion 36*a* separated from a second channel portion 36*b* by the connection post 34.

The slider 11 extends in a second direction C, perpendicular to the third direction B, from a head end 38 of the slider to a tail end 40 of the slider 11. The Y-shaped channel 36 also includes a third channel portion 36*c* which adjoins the first and second channel portions 36*a*, 36*b* in the vicinity of a tail end of the connection post 34.

The first channel portion 36*a* and second channel portion 36*b* have respective first and second openings 46*a*, 46*b* at the head end 38 of the slider 11. The third channel portion 36*c* has a third opening 46*c* at the tail end 40 of the slider 11.

The slide fastener shown in FIG. 4 is a coil zipper—i.e. a slide fastener in which the coupling elements of each stringer are formed as a continuous coil. The embodiments shown in other Figures within the application are injection moulded or possibly metal zippers in which the coupling elements of each stringer are formed as a plurality of separate coupling elements. It will be appreciated that the exact structure of the coupling elements is not relevant to the present invention and that, as such, the coupling elements within each of the figures can be treated as being equivalent.

Figure 5:
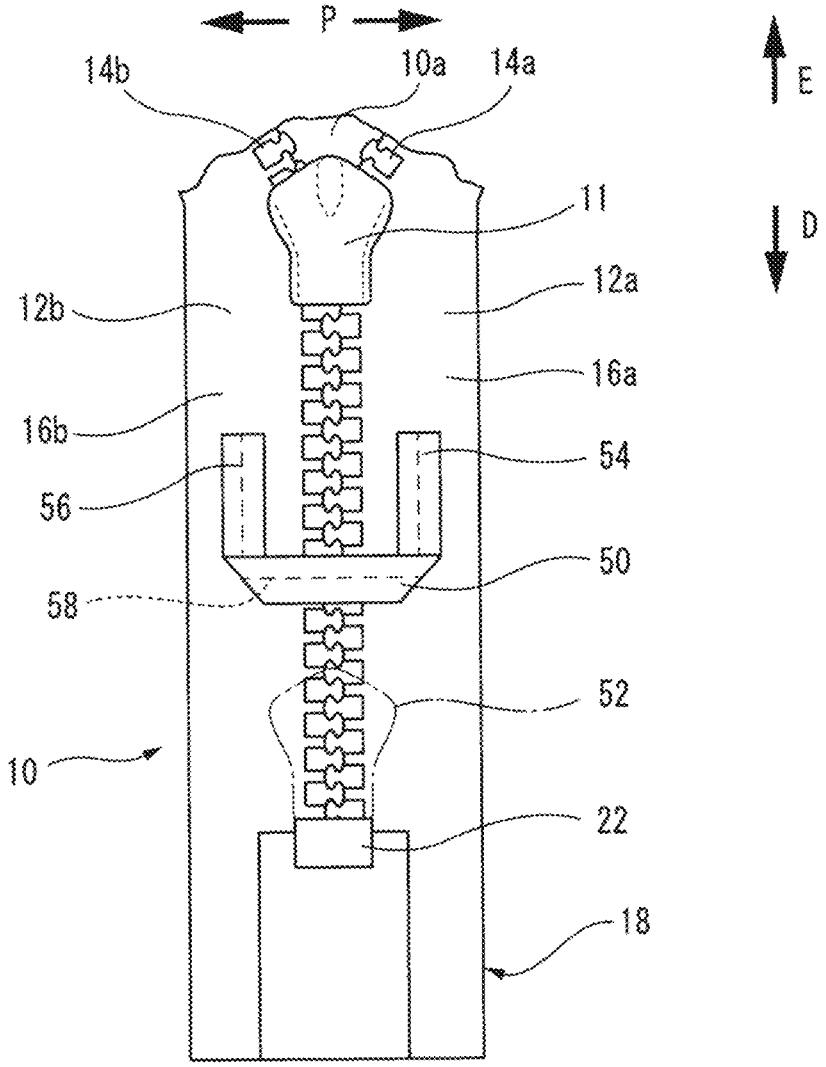
FIG. 5 is a schematic view of a known slide fastener which includes a reinforcing strap.

FIG. 5 shows a known slide fastener 10 which further includes a slide fastener reinforcing strap 50 (also simply referred to as "reinforcing strap" or "strap").

The reinforcing strap 50 is secured across an opening 10*a* formed between first and second tapes 16*a*, 16*b* of the slide fastener 10 when the slider 11 is in an open configuration (shown in dashed lines 52). The slide fastener reinforcing strap 50 extends from a first end 54 to a second end 56 along a centreline (dashed line 58).

The first end 54 of the reinforcing strap 50 is attached to the first tape 16*a* and the second end 56 of the strap 50 is attached to the second tape 16*b*. The strap 50 is folded back on itself so that the strap 50 (and hence the centreline 58 of the strap) are generally U-shaped.

In use, if a force is applied to at least one of the stringers 12*a*, 12*b*, which urges the stringers apart (e.g. in either of the directions indicated by an arrow P), then the strap 50 prevents the stringers from being urged apart to the extent that damage to the slide fastener may occur, for example, by causing the stringers to be pulled apart at the bottom stop 22.

Figure 6:
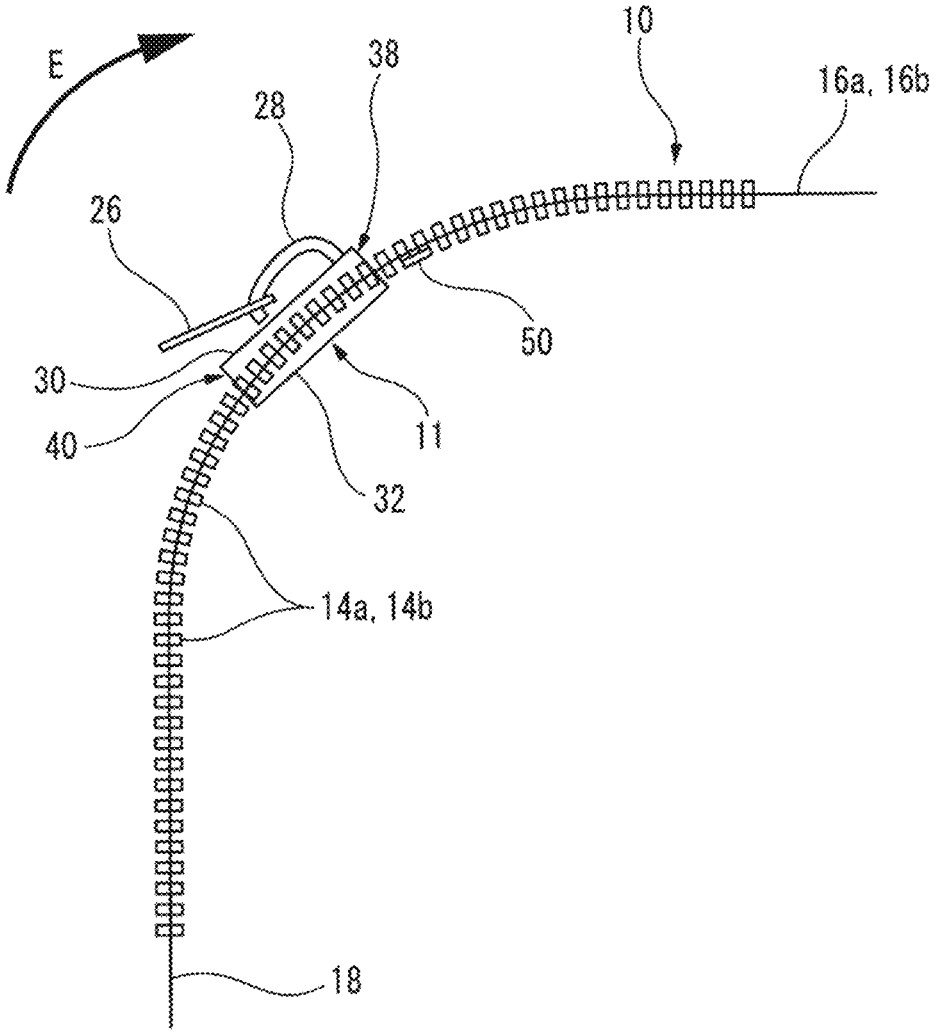
FIG. 6 is a schematic side view of a portion of a slide fastener of the type shown in FIG. 1 which has been bent.

Some applications of slide fastener require that the slide fastener is bent about an axis which is perpendicular to both the second direction C (which is generally the same as the longitudinal axis L of the chain 18) and the third direction B (which is generally the same as a perpendicular to the plane of the chain 18). This may happen, for example, when a slide fastener forms part of a suitcase at the portions of the slide fastener which pass around a corner of the suitcase or when a slide fastener forms part of an article such as a dry suit in which the slide fastener passes over curves of the body of a wearer, such as the shoulder and/or hip. FIG. 6 shows a cross-sectional side view of a slider 11 at a location along a chain 18 at which the slide fastener is bent in a manner discussed above.

As can be seen in FIG. 6, when the slide fastener is bent as previously discussed, and the slider 11 is moved in the first sliding direction E, then it is possible that the strap 50 will snag on the head end 38 of the slider 11. If this occurs then at least one of several undesirable things may happen.

First, the strap 50 may prevent the slider 11 from moving any further along the slider fastener, thereby preventing the slide fastener from closing (i.e. such that all of the coupling elements of the stringers are coupled together). Secondly, if sufficient force is applied to the slider, then it is possible that the strap 50 will be torn or detached from the slide fastener. In either of these cases, it will be appreciated that the strap 50 will no longer be able to perform its function in assisting in protecting the slider fastener from being damaged. Thirdly, it is possible that the force applied to the slider 11 is transmitted through the strap 50 to at least one of the stringers, thereby causing the coupling elements of the stringers to become misaligned or cause the coupling elements to be wrenched out of at least one of the first channel portion 36*a* and the second channel portion 36*b* of the slider. In either of these cases the slider fastener will not function correctly.

Additionally, it is possible that a portion of the strap 50 will pass into one of the first channel portion 36*a* and the second channel portion 36*b* of the slider 11 and will either jam the slider so that it can no longer slide along the stringers, or push a coupling element out of position. Pushing a coupling element out of position may result in the slider jamming (i.e. because interdigitation of the coupling elements is not possible with a misaligned coupling element), the coupling element of each stringer coupling to one another in a misaligned position—which may result in the slide fastener not fastening correctly. Finally, a misaligned coupling element may result in the coupling element being forced out of a channel portion of the slider within which it is located. Again, this will result in the slider being incapable of functioning correctly.

A similar problem relating to the strap snagging on the slider may also occur when a slide fastener including a reinforcing strap forms part of an article which is close fitting—for example, a dry-suit or a dress etc. In such situations, the close fitting nature of the article may result in the reinforcing strap being urged into the path of the slider (for example by the body of a person wearing the article) such that, again, the strap is caused to snag on the slider. The problems resulting from such snagging has already been discussed above and, as such, not repeated here.

It is an object of the present invention to provide a reinforcing strap which overcomes or minimises the problems discussed above.

Figure 7:
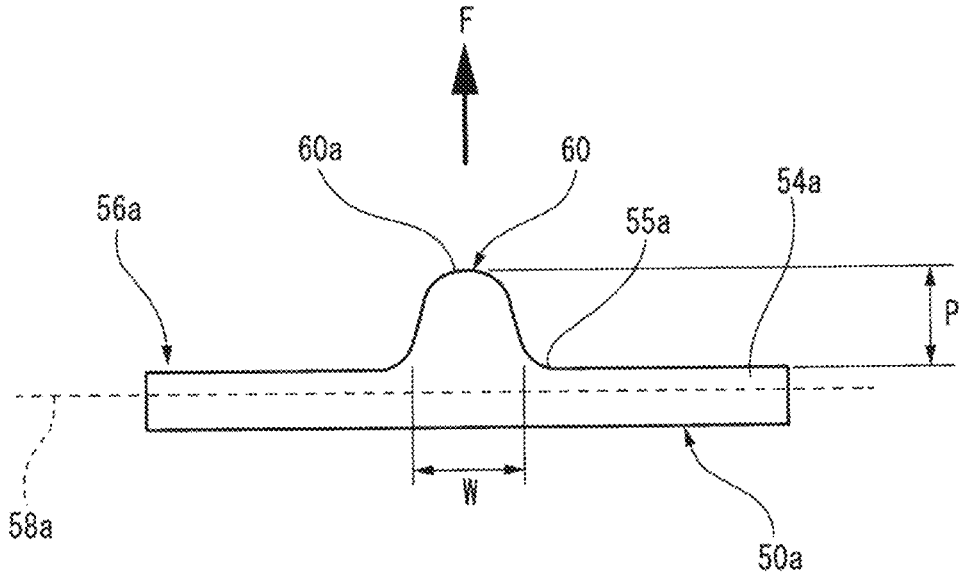
FIG. 7 is a schematic plan view of a slide fastener reinforcing strap according to an embodiment of the invention.

FIG. 7 shows a slide fastener reinforcing strap 50*a* according to an embodiment of the present invention. In some applications the reinforcing strap 50*a* may take the place of the prior art reinforcing strap 50 shown in FIG. 5.

The slide fastener reinforcing strap 50*a* may be secured across the opening 10*a* formed between the first and second tapes of a slide fastener. For example, if the slide fastener reinforcing strap 50*a* were to replace the strap 50 shown within FIG. 5, the strap 50*a* would be secured across the opening 10*a* formed between the first tape 16*a* and the second 16*b* when the slide fastener 10 is an open configuration in which the slider 11 is located at an open position indicated by dashed lines 52.

The reinforcing strap 50*a* extends from a first end 54*a* to a second end 56*a* along a centreline 58*a* which extends a right and left direction of the slide fastener. The strap 50*a* includes a first protrusion 60 between the first end 54*a* and second end 56*a*. The first protrusion 60 extends away from the centreline 58*a* in a first direction F. The first direction F is substantially perpendicular to the centreline 58*a*. The first protrusion 60 extends away from the centreline 58*a* to a free end 60*a* of the first protrusion 60. The centreline 58*a* is a virtual line which extends in the right and left direction of the slide fastener when the reinforcing strap 50 shown in FIG. 5 is replaced by the reinforcing strap 50*a*.

The reinforcing strap 50*a* is generally planar such that it lies in a first plane. In this case, the first plane is the plane of the page on which the figure lies. However, it will be appreciated that in other embodiments, the reinforcing strap may not be planar provided it can function in the manner discussed in more detail later in this document.

It can be seen that the first direction F lies within the first plane.

The reinforcing strap 50*a* may be formed from a flexible material for example, it may be formed from a woven material coated with a film of plastic material for example, the strap may be formed from a vinyl laminated polyester or a vinyl coated polyester. The flexibility of the flexible material is greater than that of the coupling elements 14*a*, 14*b*. The flexibility of the flexible material is equal to or greater than that of the tapes 16*a*, 16*b*.

In some embodiments, the reinforcing strap may be made from the same material as that from which the tapes the slide fastener are formed.

As previously discussed, the reinforcing strap 50*a* may take the place of the reinforcing strap 50 shown within FIG. 5. As such, according to another aspect of the present invention, there is provided a slide fastener and a slide fastener reinforcing strap, wherein the slide fastener 10 includes first and second fastener tapes 16*a*, 16*b* and a slider 11. Each fastener tape includes a coupling portion (in this case comprising coupling elements 14*a*, 14*b*) provided along an edge of the fastener tape 16*a*, 16*b*. The coupling portions 14*a*, 14*b* of the fastener tapes 16*a*, 16*b* are located adjacent one another. The coupling portions 14*a*, 14*b* of the first and second fastener tapes 16*a*, 16*b* are received by the slider 11. The slider is configured such that movement of the slider relative to the fastener tapes in a first sliding direction E draws the coupling portions into securing engagement with one another, and such that movement of the slider 11 relative to the fastener tapes in a second sliding direction D, generally opposite to the first sliding direction E, separates the coupling portions 14*a*, 14*b* from each other.

The slide fastener reinforcing strap 50*a* is orientated relative to the slide fastener 10 such that the first direction F in which the first protrusion 60 extends away from the centreline 58*a* is the same as the second sliding direction D. The first direction F is the same as a direction towards the bottom stop 22. The slide fastener reinforcing strap 50*a* is located such that the first protrusion 60 extends away from the centreline 58*a* in the first direction F by an amount sufficient to ensure that the first protrusion 60 of the reinforcing strap 50*a* overlaps the slider 11 when the slider 11 is positioned such that the slider 11 abuts the bottom stop 22.

In the particular embodiment shown in FIG. 5 (when the reinforcing strap 50 is replaced with the reinforcing strap 50*a*) and in FIG. 10—discussed in more detail later—the reinforcing strap 50*a*, 50*b* is folded back on itself such that the centreline 58*a* forms a U-shape. In other embodiments, this need not be the case. For example, in some embodiments, the reinforcing strap may not be folded over on itself such that the centreline remains straight. In other embodiments the reinforcing strap may be folded into any appropriate shape provided the reinforcing strap can function in the manner discussed further below within this document.

In the embodiments described within this document, the slide fastener reinforcing strap 50*a*, 50*b* is orientated relative to the slide fastener 10 such that the centreline at the first and second ends 54*a*, 56*a* of the slide fastener reinforcing strap 50*a* is substantially parallel to the first and second sliding directions E, D. The reinforcing strap 50*a*, 50*b* is also orientated such that the centreline 58*a* in the region of (i.e.

proximate) the first protrusion 60 is substantially perpendicular to the first and second sliding directions E, D.

FIGS. 8A to 8D show a way in which a slide fastener reinforcing strap including a first protrusion according to the present invention acts so as to reduce the likelihood that the slider of a slide fastener with which the reinforcing strap is associated will snag on the slider.

FIGS. 8A to 8D show a schematic side view of a portion of a slider fastener 10 with which a reinforcing strap 50*a* according to the present invention is associated. In the example shown the reinforcing strap is located on the rear side of the slide fastener (i.e. on the side of the slide fastener opposite that on which the puller 26 of the slider 11 of the slide fastener is located). Within these figures the reinforcing strap 50*a* is orientated such that its centreline (not shown within these figures) is perpendicular to the plane of the page on which the figure lies—that is to say, such that it passes directly into the plane of the page on which the figure lies. In addition, the reinforcing strap 50*a* is orientated relative to the slide fastener such that the first direction F in which the first protrusion 60 extends is in the same direction as the second sliding direction D (i.e. in the opposite direction to the first sliding direction E).

Figure 8A:
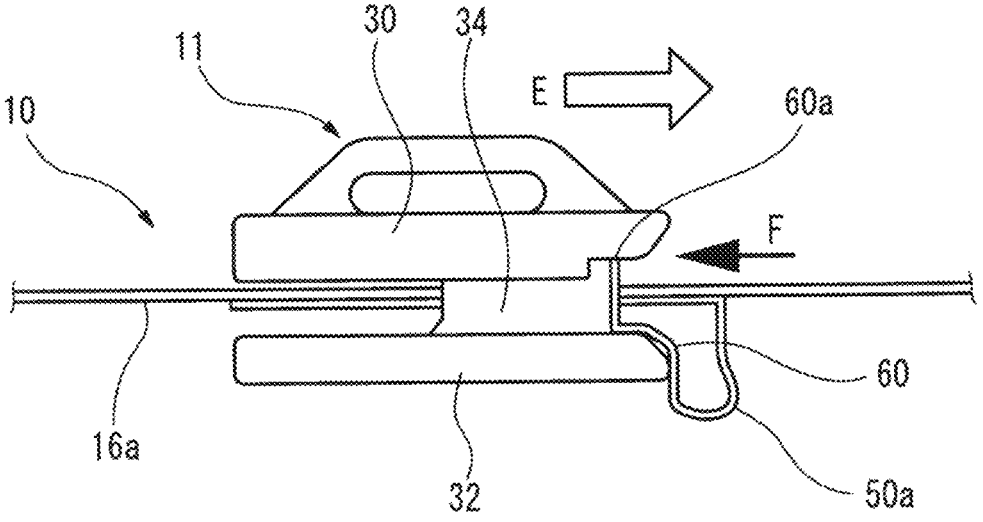
FIG. 8A is a side view showing a state where a slider moves along a first sliding direction and a protrusion of the reinforcing strap moves to a position to be received between an upper portion and a lower portion.

FIG. 8A shows a view from the right hand side in FIG. 5 with the prior art strap 50 replaced by the strap 50*a* (according to the present invention). As such, the first tape 16*a* and coupling elements 14*a* which are attached to the tape 16*a* are both visible. Within FIGS. 8B to 8D the coupling elements 14*a* have been removed so as to aid the clarity of the figures.

FIGS. 8A to 8D show a progression of figures of a slide fastener as the slider 11 of the slide fastener 10 is moved in the first sliding direction E. Without wishing to be bound by theory, the following section of the description attempts to explain the mechanism by the reinforcing strap according to the present invention is substantially prevented from snagging on a slider of an associate slide fastener.

It will be appreciated that although within FIG. 8A the coupling elements are shown, due to the fact that the tapes and associated coupling elements diverge at the head end 38 of the slider 11 (see space between coupling element 14*a*, 14*b* at the top of FIG. 5) there are no coupling element present in advance of the centre of the head end 38 of the slider 11 adjacent the diamond 34 (e.g. for example to the left of the diamond 34 as shown in FIG. 4).

The reinforcing strap 50*a* is aligned relative to the slide fastener such that the first protrusion 60 is centred along the longitudinal axis L of the chain of the slider.

Considering each of FIGS. 8A to 8D in turn, it can be seen that in FIG. 8A the slider 11 has moved along the slide fastener to a position in which the first protrusion 60 of the reinforcing strap 50*a* is received between an upper portion 30 of the slider 11 and a lower portion 32 of the slider 11. During this time the strap 50*a* contacts the edge of the lower portion 32 at the head end 38 of the slider 11. It will be appreciated that the strap 50*a* contacts the slider in this case because the first protrusion 60 of the reinforcing strap 50*a* is above the plane of the lower portion 32 of the slider 11 as the slider 11 approached the reinforcing strap 50*a*. This may occur in a situation where, for example, the slide fastener is bent or the slide fastener forms part of a close fitting garment. In other cases, the first protrusion 60 will simply pass over the lower portion 32 of the slider 11.

In addition, the free end 60*a* of the first protrusion 60 contacts the connection post 34. As the slider 11 moves in the first sliding direction E between the position shown in FIG. 8A and that shown in FIG. 8B the reinforcing strap 50*a* slides along the head end edge of the lower portion 32 of the slider 11 and along a face 62 of the diamond 34 which is located at the head end of the diamond 34.

Figure 8B:
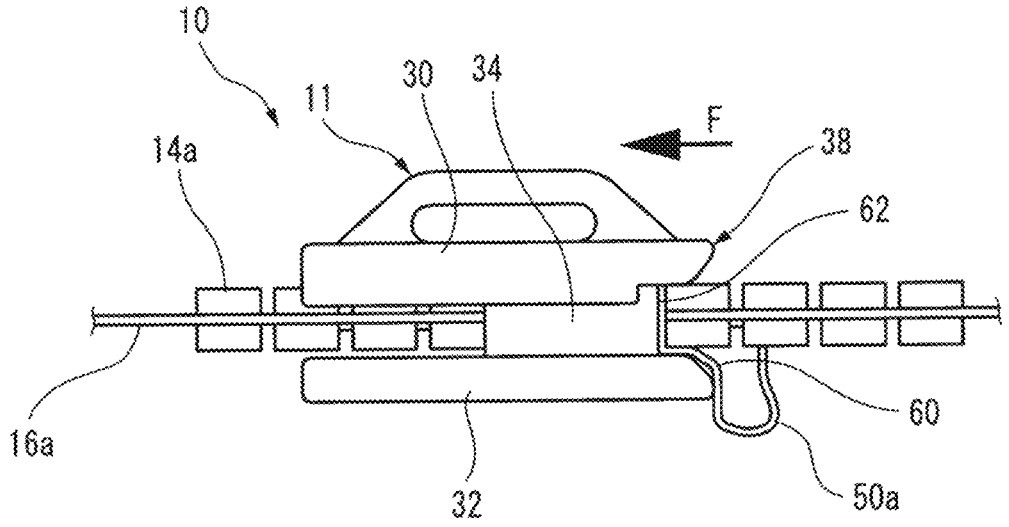
FIG. 8B is a side view showing a state where the slider moves along the first sliding direction and a free end of the reinforcing strap comes into contact with the upper portion of the slider.

Once a slider reaches the position shown in FIG. 8B, the free end 60*a* of the first protrusion 60 of the reinforcing strap contacts, in this example, the upper portion 30 of the slider 11. As the slider 11 continues to move in the first sliding direction E from the position shown in FIG. 8B to the position shown in FIG. 8C, the edge of the lower portion 32 of the slider 11 at the head end 38 of the slider 11 acts as a pivot point along which the first protrusion 60 slides.

Figure 8C:
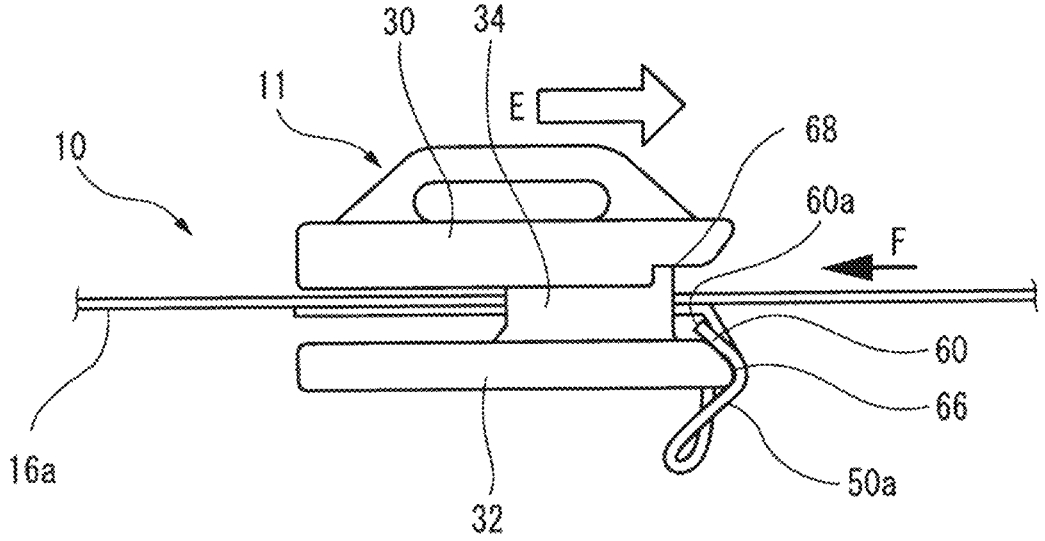
FIG. 8C is a side view showing a state where the slider moves along the first sliding direction and the protrusion slides along the lower portion of the slider.
Figure 8D:
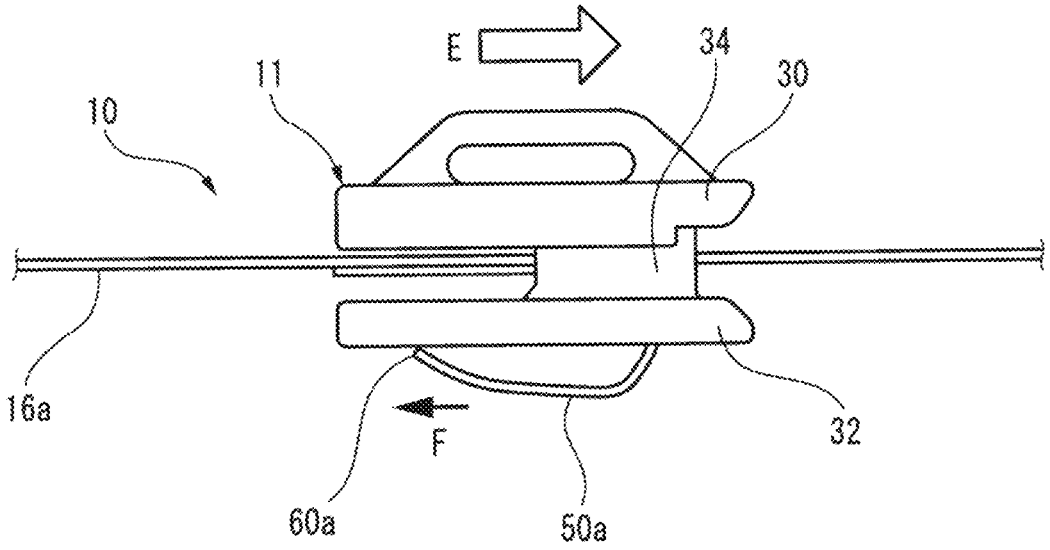
FIG. 8D is a side view showing a state where the slider moves along the first sliding direction, the protrusion is flipped over the lower portion of the slider, and the free end of the protrusion moves below the lower portion of the slider.

Finally, as the slider continues to move in the first sliding direction E beyond the position shown in FIG. 8C, the first protrusion 60 is flipped over the edge of the lower portion 32 of the slider 11 at the head end 38 of the slider 11 as shown in FIG. 8D, such that the free end 60*a* of the first protrusion 60 comes to rest on or near the underside of the lower portion 32 of the slider 11.

In the manner discussed above in relation to the FIGS. 8A to 8D, the protrusion 60 of the slide fastener reinforcing strap 50*a* prevents the reinforcing strap 50*a* from snagging on the slider 11. Instead, the reinforcing strap 50*a* passes over the slider as the slider is moved in the first sliding direction E. It will be appreciated that by preventing the reinforcing strap 50*a* from snagging on the slider 11 that all of the aforementioned disadvantages of the prior art reinforcing straps are overcome.

The applicant has discovered that, in some embodiments, if the first protrusion 60 has a width W which is too small, the first protrusion may get pulled into the first channel portion 36*a* or the second channel portion 36*b* of the Y-shaped channel 36 of the slider 11. If this happens, the slider 11 may become jammed, the reinforcing strap may be damaged and/or the slide fastener may be damaged. Consequently, the applicant has determined that, in some embodiments, it is desirable for the width W of the first protrusion 60 to be greater than a certain amount. This is discussed in more detail below.

As previously discussed a slider comprises an upper portion 30 connected to a lower portion 32 by a connection post 34 extending in a third direction B from the upper portion 30 to the lower portion 32. The upper portion 30, lower portion 32 and connection post 34 cooperate to define a Y-shaped channel having a first channel portion 36*a* separated from a second channel portion 36*b* by the connection post 34, and a third channel portion 36*c* which adjoins the first channel portion 36*a* and the second channel portion 36*b*.

The coupling portion 14*a* of the first fastener tape 16*a* is received by the first and third 5 channel portions 36*a*, 36*c* of the Y-shaped channel of the slider 11. The coupling portion 14*b* of the second fastener tape 16*b* is received by the second channel portion 36*b* and third channel portion 36*c* of the Y-shaped channel of the slider 11.

The width W of the first protrusion 60, for example the free end 60*a* of the first protrusion 60 (parallel to the portion of the centreline which is proximate the protrusion) is greater than the width W1 of an entrance 46*a* to the first channel portion 36*a* of the Y-shaped channel 36 and/or than the width W2 of an entrance 46*b* to the second channel portion 36*b* of the Y-shaped channel 36. The widths of the entrances can best be seen in FIG. 4. The width of the entrance to the first channel portion 36*a* and the width of the entrance to the second channel portion 36*b* are in a direction which is substantially parallel to the centreline 58*a* of the reinforcing strap 50*a* proximate the first protrusion 60 (in some embodiments, this may be equivalent to the width being measured in a direction which is substantially perpendicular to the longitudinal axis L of the chain and/or to the first and second sliding directions E, D).

The width W of the first protrusion 60, for example the free end 60*a* of the first protrusion 60, parallel to the longitudinal axis L may be greater than the width of the coupling elements (measured in a direction perpendicular to the longitudinal axis L of the chain).

The applicant has also determined that in some embodiments it may be beneficial for 25 the first protrusion 60 to extend away from a portion 55*a* of the slider fastener reinforcing strap 50*a* adjoining the first protrusion 60 by a distance P which is greater than a particular amount. The distance P may be measured in the first direction F.

By ensuring in the relevant embodiments that the distance P is greater than a particular amount, it is thought that this may assist in permitting the reinforcing strap 50*a* to slide over the slider 11 whilst the slider is moved in the first sliding direction E, as shown in FIGS. 8A to 8D. For example, it is thought that if the distance P is too short then the effect by which the edge of the lower portion 32 of the slider 11 at the head end 38 of the slider 11 acts as a pivot point along which the first protrusion 60 slides, and by which the first protrusion 60 is flipped over the edge of the lower portion 32 of the slider 11 at the head end 38 of the slider 11 such that the free end 60*a* of the first protrusion 60 comes to rest on the underside of the lower portion 32 of the slider 11, is prevented from occurring, thereby potentially allowing snagging of the reinforcing strap on the slider to occur.

In some embodiments it is desirable that the distance P is greater than the distance between a forward-most tip 66 of the lower portion 32 and the forward-most point 68 at which the connection post 34 adjoins the upper portion 30. By forward-most, what is meant is the portion which is located on the slider furthest in the first sliding direction E. Or put another way, by forward-most, what is meant is the portion which is located on the slider as close as possible to the head end 38 of the slider 11.

In other embodiments it is desirable that the distance P is greater than half the distance in the third direction B between the upper portion 30 and the lower portion 32.

Figure 9:
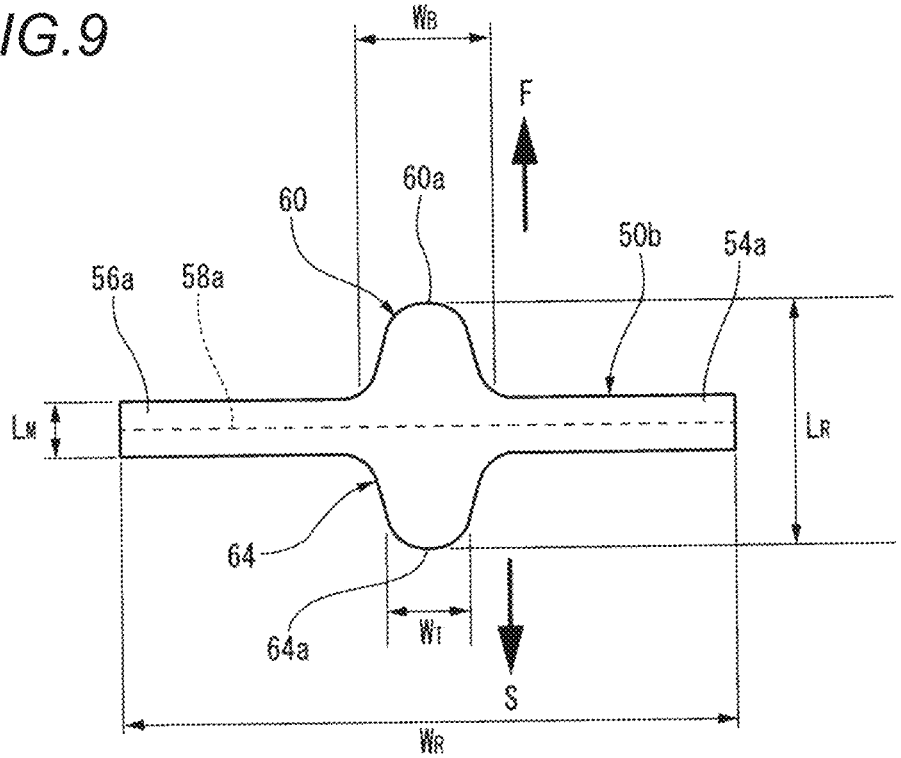
FIG. 9 is a schematic plan view of a slide fastener reinforcing strap according to another embodiment of the invention.

FIG. 9 shows a schematic plan view of a slide fastener reinforcing strap 50*b* according to a further embodiment of the present invention. In common with the reinforcing strap shown in FIG. 7, the reinforcing strap 50*b* shown in FIG. 9 extends from a first end 54*a* to a second end 56*a* along a centreline 58*a*. The reinforcing strap 50*b* includes a first protrusion 60 between the first and second ends 54*a*, 56*a*. The first protrusion 60 is of substantially the same form as that which has already been described in relation to the embodiment shown in FIG. 7. Consequently, for brevity, unnecessary repetition of the description of this feature is avoided.

In addition, the reinforcing strap 50*b* also includes a second protrusion 64 which 25 extends away from the centreline 58*a* (specifically, the portion of the centreline proximate the second protrusion 64) in a second direction S which is perpendicular to the centreline 58*a* (specifically, the portion of the centreline proximate the second protrusion 64). The second direction S is also generally opposite to the first direction F. The second protrusion 64 extends in said second direction S away from the centreline 58*a* (specifically, the portion of the centreline proximate the second protrusion 64) to a free end 64*a* of the second protrusion 64. In the embodiment shown in FIG. 10, the second direction S is the same as a direction towards the end stop 22 and the first direction F is the same as a direction away from the end stop 22.

Figure 10:
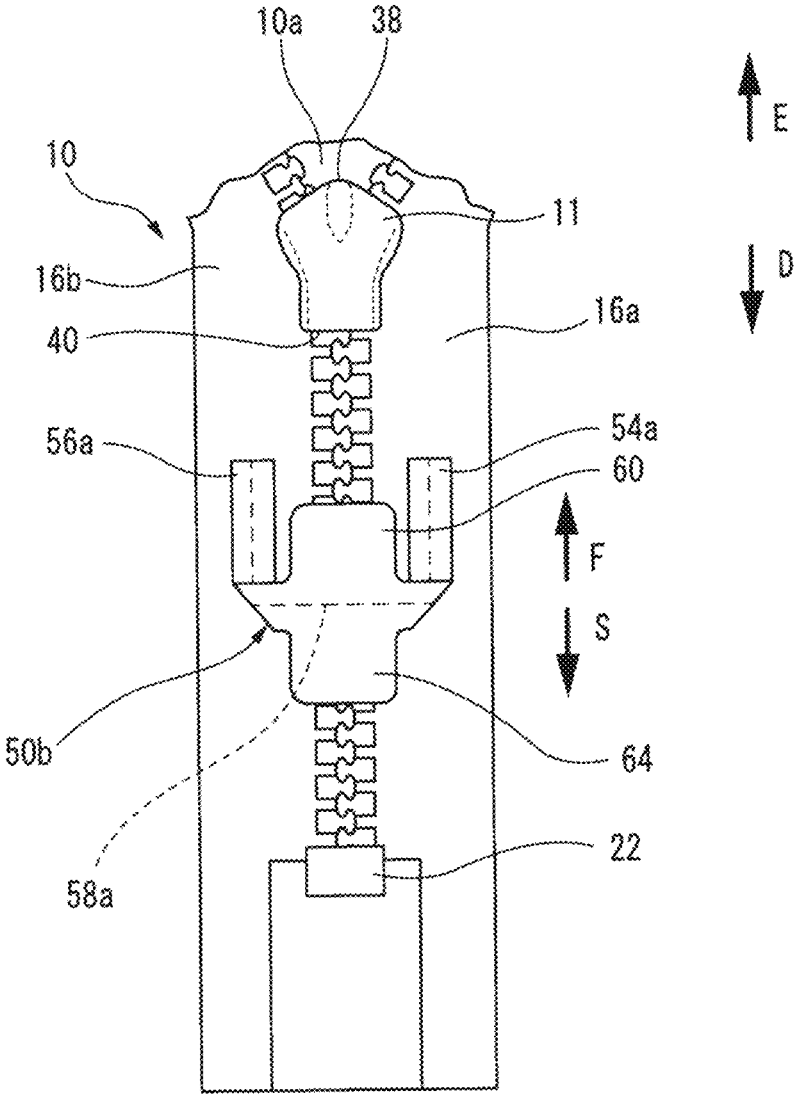
FIG. 10 is a schematic view of a slide fastener according to an embodiment of the present invention which includes the reinforcing strap shown in FIG. 9.

FIG. 10 shows a schematic view of a slide fastener 10 including a reinforcing strap 50*b* of the type shown in FIG. 9. It will be noted that the slide fastener according to an embodiment of the present invention shown in FIG. 10 is similar to the prior art slide fastener shown in FIG. 5 except that the prior art reinforcing strap shown in FIG. 5 is replaced by the reinforcing strap 50*b* according to an embodiment of the present invention. Corresponding features and directions within FIGS. 5 and 10 are referred to using the same reference characters. For brevity, features of the slide fastener shown within FIG. 10 which have already been discussed in relation to that in FIG. 5 are not repeated here. However, briefly, it is worth noting that the reinforcing strap 50*b* has been folded over on itself in two places (one either side of the protrusions 60, 64) so as to form a general U-shape. Consequently, the centreline 58*a* also forms a general U-shape. The first end 54*a* of the reinforcing strap 50*b* is attached to the first tape 16*a* of the slide fastener and the second end 56*a* of the reinforcing strap 50*b* is attached to the second tape 16*b* of the slide fastener 10. Such attachment may be achieved in any appropriate manner including, but not limited to, the use of welding, stitching and/or adhesive.

It will be appreciated that although in the previously discussed embodiment of reinforcing strap discussed in relation to FIGS. 7 and 5 the first direction F in which the first protrusion extends away from the centreline is generally the same as the second sliding direction D. This need not always be the case. In some embodiments, such as that shown in FIG. 10, the reinforcing strap may be orientated with respect to the slide fastener in the opposite direction so that the first direction F in which the first protrusion extends away from the centreline is generally the same as the first sliding direction E. It will also be appreciated that in embodiments of the slide fastener according to the present invention in which the reinforcing strap includes first and second protrusions 60, 64, if the direction F in which the first protrusion 60 extends is the same as the first sliding direction E, then the direction S in which the second protrusion 64 extends may be the same as the second sliding direction D. Conversely, if the reinforcing strap is orientated such that the first direction F in which the first protrusion 60 extends is the same as the second sliding direction D, then the second direction S in which the second protrusion 64 extends may be the same as the first sliding direction E.

As previously discussed, a slide fastener according to the present invention may be such that the first and second tapes 16 are secured together by an end stop. As is well known in the field of slide fasteners, the end stop limits movement of the slider relative to the first and second fastener tapes 16*a*, 16*b* in either the first sliding direction E or the second sliding direction D. Some slide fasteners will include a single end stop, whereas others may include a plurality of end stops. An end stop which limits movement of the slider relative to the first and second fastener tapes in the first sliding direction (i.e. the direction which causes the coupling elements of the stringers of the slide fastener to couple to one another) may be referred to as a top stop. The end stop 22 shown in FIG. 10 which secures the first and second tapes 16*a*, 16*b* together, limits movement of the slider 11 relative to the first and second tapes 16*a*, 16*b* in the second sliding direction D (i.e. the direction which causes the coupling element of the stringers of the slide fastener to be uncoupled from one another). Such an end stop may be referred to as a bottom stop.

With continuing reference to FIG. 10, the slide fastener reinforcing strap 50*b* is located relative to the end stop (in this case bottom stop 22) such that the reinforcing strap 50*b* will overlap the slider 11 when the slider is positioned such that it abuts the end stop 22. In more detail, when the tail end 40 of the slider 11 is contacting the bottom stop 22 (such that the slider has moved as far in the second sliding direction D as possible—and therefore the slide fastener 10 is in a fully open configuration) the second protrusion 64 of the reinforcing strap 50*b* will overlap with at least the head end 38 of the slider 11. By overlap what is meant is that the reinforcing strap (and, in this case, the second protrusion of the reinforcing strap) will overlap the slider in the first sliding direction E. In other words, when the slide fastener is viewed from above the reinforcing strap, the reinforcing strap and slider overlap so that the reinforcing strap obscures the view of part of the slider.

The benefit in the reinforcing strap being positioned so that it overlaps the slider when the slider is positioned so that it abuts the bottom stop is that when the slider is moved in the second sliding direction D to a fully open position of the slide fastener (in which the slider abuts the bottom stop) there is no way that the slider can be moved beyond the reinforcing strap 50*b*. In this way, there is no way that the reinforcing strap can obstruct the path of the slider 11 as it is moved away from the bottom stop 22 in the first sliding direction E. By preventing the reinforcing strap 50*b* from obstructing the slider 11 as it moves away from the bottom stop 22, this prevents the reinforcing strap 50*b* from snagging the slider 11.

Although FIG. 10 shows a slide fastener in which the reinforcing strap is located adjacent the bottom stop such that the reinforcing strap overlaps the slider when the slider is positioned such that it abuts the bottom stop, it will be appreciated that in other embodiments the slide fastener reinforcing strap may be located such that it overlaps the slider when the slider is positioned such that the slider abuts a top stop. In such an embodiment the head end 38 of the slider may abut the top stop and the tail end 40 of the slider may be overlapped with a portion of the reinforcing strap (e.g. the second protrusion of the reinforcing strap). If the slide fastener reinforcing strap 50*a* shown in FIG. 7 is located such that the reinforcing strap 50*a* overlap the slider when the slider is positioned such that the slider abuts the top stop, the first direction F in which the first protrusion 60 of the reinforcing strap 50*a* extends is set to be the same as the first sliding direction E. In this case, the first protrusion 60 extends away from the centreline in the first direction F by an amount sufficient to ensure that the first protrusion 60 overlaps the slider when the slider is located such that the slider abuts the top stop.

It will be appreciated that although in the previously described embodiments, the reinforcing strap is located such that the second protrusion overlaps the slider when the slider is positioned such that it abuts an end stop. In other embodiments, particularly those without a second protrusion, the reinforcing strap may be located such that any appropriate portion of the reinforcing strap overlaps the slider when the slider is positioned such that it abuts the end stop.

In some embodiments, the size of the second protrusion and the location of the slide fastener reinforcement strap are chosen so as to optimise the performance of the slide fastener. In particular, the size of the second protrusion and the location of the slide fastener reinforcing strap may be chosen such that the second protrusion extends away from the centreline 58 in the second direction S by an amount sufficient to ensure, that when the slider is positioned such that it abuts an end stop 22, the second protrusion 64 overlaps the slider 11 by a distance equal to about a third of the length of the slider measured in a direction parallel to the first sliding direction E. That is to say, a second protrusion 64 overlaps the slider by a distance equal to about a third of the distance between the forward-most portion of the slider 11 and the rear-most portion of the slider. In this context, forward-most portion and rear-most portion are defined as the portion which is located to the greatest extent in the first sliding direction, and the portion which is located to the least extent in the first sliding direction E, respectively.

The provision of this amount of overlap has been found to be particularly effective in ensuring that the reinforcing strap does not obstruct the movement of the slider when the slider moves away from the end stop.

In one embodiment of slide fastener according to the present invention, the slide fastener is a number 10 Aquaseal® zip which is manufactured and supplied publicly by the applicant. In conjunction with such a slide fastener, the dimensions of a suitable reinforcing strap 50*b* (such as that shown in FIG. 9) are as described below.

The total length $L_R$ of the reinforcing strap 50*b* (i.e. from the free end of the first protrusion 60 to the free end of the second protrusion 64 in a direction perpendicular to the centreline 58*a*) is approximately 40 mm. In the present embodiment the first protrusion 60 extends from the centreline 58*a* in the first direction F by substantially the 10 same distance that the second protrusion 64 extends from the centreline 58 in the second direction S. As such, in each case the distance the first protrusion extends from the centreline and the distance the second protrusion extends from the centreline is about 20 mm. It will be appreciated that in other embodiments, the distance the first protrusion extends from the centreline may be different to the distance that the second protrusion extends from the centreline.

The width $L_M$ of the first and second ends 54*a*, 56*a* in a direction perpendicular to the centreline 58*a* is about 10 mm.

A width of the free ends 60*a*, 64*a* of each of the first and second protrusions 60, 64 is about 11 mm and is indicated by the reference symbol $W_T$. A width of a base portion of each of the first protrusion 60 and second protrusion 64 (the base portions being located proximate the centreline) is about 17 mm and is shown by the reference symbol $W_B$. Both of the aforementioned widths $W_T$ and $W_B$ are measured in a direction parallel to the centreline 58*a* (and, in particular, a portion of the centreline proximate the protrusion 60, 64). It will be appreciated that, although in the present embodiment the widths $W_T$ and $W_B$ for each of the first and second protrusions are the same, in other embodiments this need not be the case.

The width $W_R$ of the reinforcing strap 50*b* from the first end 64*a* to the second end 56*a*, measured along the centreline 58*a*, is about 100 mm.

It will be appreciated that in some embodiments the distances $W_R$, $W_T$, $W_B$, $L_M$ and the distance which the first protrusion extends in the first direction from the centreline to the free end of the first protrusion may be the same for the embodiment shown in FIG. 7 as for the embodiment shown in FIG. 9.

As previously discussed, a slide fastener according to the present invention may or may not be a water-tight slide fastener. In the case that the slide fastener is a water-tight slide fastener, the water-tight slide fastener is configured such that, in a closed configuration of the slide fastener, water is substantially prevented from passing through the slide fastener.

Figure 11:
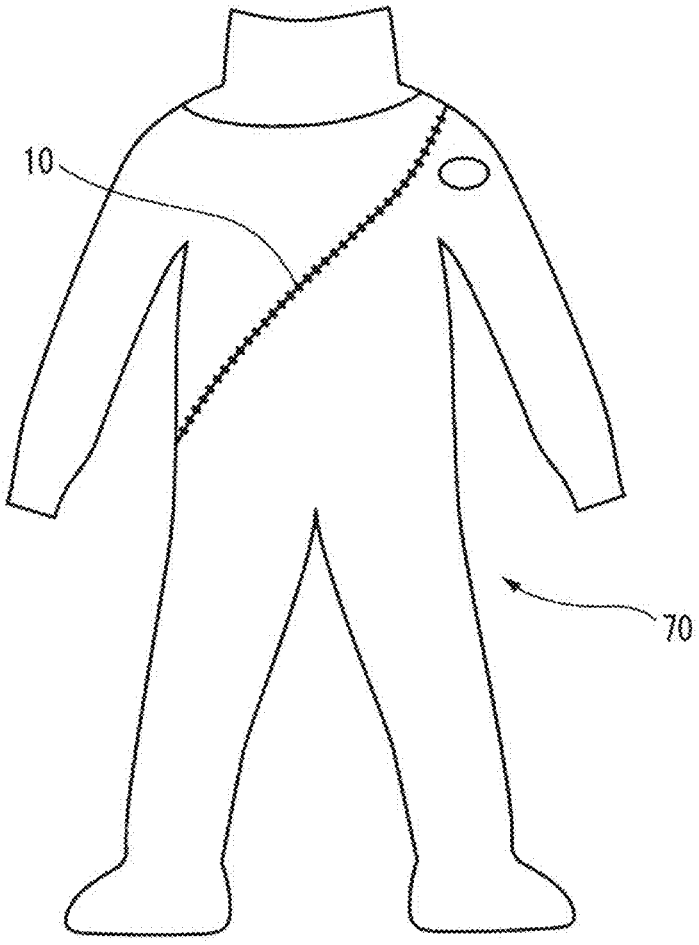
FIG. 11 shows a first article according to the present invention which includes a slide fastener according to the present invention.

The present invention also encompasses an article including a slide fastener of the type discussed above. Such an article is shown in FIG. 11. FIG. 11 shows an article in the form of a dry suit 70. The dry suit 70 includes a slide fastener 10 which extends across the dry suit such that it passes around a hip portion of the dry suit and over a shoulder portion of the dry suit. Although the article according to the present invention shown in FIG. 11 is a dry suit, it will be appreciated that a slide fastener according to the present invention may be applied to any appropriate article.

Figure 12:
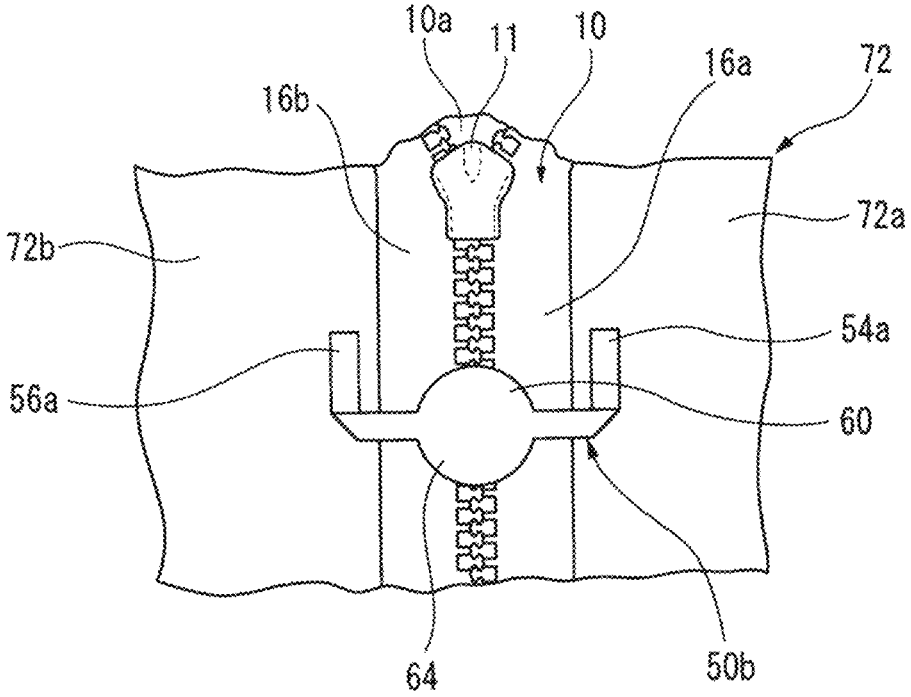
FIG. 12 shows a portion of a second article according to the present invention which includes a slide fastener reinforcing strap according to the present invention.

FIG. 12 shows a portion of an article 72 which includes a slide fastener reinforcing strap 50*b* according to the present invention. A slide fastener reinforcing strap 50*b* is secured across an opening 10*a* formed between the first and second tapes of the slide fastener as follows. The first end 54 of the reinforcing strap 50*b* is attached to a first portion 72*a* of the article 72. The second end 56 of the reinforcing strap 50*b* is attached to a second portion 72*b* of the article 72. The first fastener tape 16*a* of the slide fastener 10 is located adjacent to the first portion 72*a* of the article 72 and attached to the first portion 72*a* of the article 72. In this manner the first fastener tape 16*a* is located in between the first portion 72*a* of the article 72 and the second fastener tape 16*b*. The second fastener tape 16*b* of the slider fastener 10 is located adjacent to the second portion 72*b* of the article 72 and attached to the second portion 72*b* of the article 72. In this way, the second fastener tape 16*b* is located in between the second portion 72*b* of the article 72 and the first fastener tape 16*a*.

In some embodiments, such as those previously described, the protrusions and the remaining portion of the reinforcement strap are of unitary construction. In other embodiments the first protrusion and, if present second protrusion may be formed from at least one portion which is separate from, but fixed in any known manner to the remaining portion of the reinforcement strap.

In the above embodiments, the first protrusion and the second protrusion are formed between two folded portions at which the reinforcing strap is folded back to form a U-shape. The centreline of the reinforcing strap between two folded portions is perpendicular to the first direction, the centreline from the folded portion to the first end extends in the same direction as the first direction, and the centreline from the folded portion to the second end extends in the same direction as the first direction. When a direction in which the first protrusion extends is the second sliding direction, the first protrusion extends in a direction opposite to a direction towards the first end or the second end from the folded portion of the reinforcing strap. When a direction in which the second protrusion extends is the same direction as the first sliding direction, the second protrusion extends in the same direction as a direction toward the first end or the second end from the folded portion of the reinforcing strap. It is preferable that the reinforcing strap is located proximate the end stop which limits movement of the slider. The first end and the second end are orientated to the first sliding direction as seen from the folded portions if the reinforcing strap is located proximate the end stop (bottom stop) which limits movement of the slider in the second sliding direction relative to the first and second fastener tapes. The first end and the second end are orientated to the second sliding direction as seen from the folded portions if the reinforcing strap is located proximate the end stop (top stop) which limits movement of the slider in the first sliding direction relative to the first and second fastener tapes. If the folded portions are formed as creases in advance, the plane including the centreline sandwiching the folded portions become parallel and thus it is possible to suppress volume. On the other hand, it is non-essential to form the creases in advance. In this case, the folded portions are created by variation in the direction of the centreline, as mentioned above.

DESCRIPTION OF REFERENCE NUMERALS

10 Known Slide Fastener
11 Slider
12*a*, 12*b* Stringer
14*a*, 14*b* Coupling Element
16*a*, 16*b* Fastener Tape
18 Chain
20*a*, 20*b* Top Stop (End Stop)
22 Bottom Stop (End Stop)
24 Main Body
26 Pull Tab
28 Bridge Portion
30 Upper Portion
32 Lower Portion
34 Connection Post
36 Y-shaped channel
36*a* First Channel Portion
36*b* Second Channel Portion
36*c* Third Channel Portion
38 Head End of Slider
40 Tail End of Slider
42, 44 Lateral Flange
46*a* First Opening, Entrance
46*b* Second Opening, Entrance
46*c* Third Opening
50, 50*a*, 50*b* Slide Fastener Reinforcing Strap
54, 54*a* First End
56, 56*a* Second End
58, 58*a* Centreline
60 First Protrusion
60*a* Free End
64 Second Protrusion
66 Forward-Most Tip
68 Forward-Most Point
70 Dry Suit
72 Article
72*a* First Portion
72*b* Second Portion
L Longitudinal Axis
E First Sliding Direction
D Second Sliding Direction

The invention claimed is:

1. A slide fastener reinforcing strap for securing across an opening formed between first and second tapes of a slide fastener, wherein the slide fastener reinforcing strap is attached to the first and second fastener tapes, each fastener tape includes a coupling portion provided along an edge of the fastener tape, wherein the coupling portions of the fastener tapes are located adjacent one another, wherein the slide fastener reinforcing strap extends from a first end to a second end along a centreline, wherein the slide fastener reinforcing strap includes a first protrusion between the first and second ends, wherein the first protrusion extends in a first direction which is perpendicular to the centreline, wherein the slide fastener reinforcing strap including the first protrusion is planar and the slide fastener reinforcing strap and the first protrusion lie in a first plane, wherein the slide fastener includes a slider, wherein the coupling portions of the first and second fastener tapes are received by the slider, wherein the slider is configured such that movement of the slider relative to the fastener tapes in a first sliding direction causes the coupling portions to engage with one another, and such that movement of the slider relative to the fastener tapes in a second sliding direction opposite to the first sliding direction, causes the coupling portions to separate from each other, wherein the first and second fastener tapes are secured together by an end stop, wherein the end stop limits movement of the slider relative to the first and second fastener tapes in the first sliding direction or the second sliding direction, and wherein the slide fastener reinforcing strap is located such that the slide fastener reinforcing strap overlaps the slider when the slider is positioned such that the slider abuts the end stop.

2. The slide fastener reinforcing strap according to claim 1, further comprising a second protrusion which extends in a second direction which is perpendicular to the centreline and which is opposite to the first direction.

3. The slide fastener reinforcing strap according to claim 1, wherein the first direction lies within the first plane.

4. The slide fastener reinforcing strap according to claim 1, further comprising a second protrusion which extends in a second direction which is perpendicular to the centreline and which is opposite to the first direction, wherein the second direction lies within the first plane.

5. The slide fastener reinforcing strap according to claim 1, wherein the reinforcing strap comprises two pre-folds configured to enable the reinforcing strap to be preferentially folded so that the reinforcing strap substantially forms the shape of a letter U.

6. The slide fastener according to claim 1, wherein the slide fastener reinforcing strap is orientated relative to the slide fastener such that the first direction in which the first protrusion extends away from the centreline is the same direction as the second sliding direction.

7. The slide fastener according to claim 1, wherein the slide fastener reinforcing strap is orientated relative to the slide fastener such that the first direction in which the first protrusion extends away from the centreline is the same direction as the first sliding direction.

8. The slide fastener according to claim 1, wherein the slide fastener reinforcing strap is folded back such that the centreline forms a U-shape.

9. The slide fastener according to claim 8, wherein the slide fastener reinforcing strap is orientated relative to the slide fastener such that the centreline at the first and second ends of the slide fastener reinforcing strap is parallel to the first and second sliding directions and such that the centreline in the region of the first protrusion is perpendicular to the first and second sliding directions.

10. The slide fastener according to claim 1, wherein the slider comprises an upper portion connected to a lower portion by a connection post extending in a third direction from the upper portion to the lower portion, wherein the upper portion, the lower portion and the connection post co-operate to define a Y-shaped channel having a first channel portion separated from a second channel portion by the connection post, and a third channel portion which adjoins the first and second channel portions, wherein the coupling portion of the first fastener tape is configured to be received by the first and third channel portions of the Y-shaped channel of the slider, wherein the coupling portion of the second fastener tape is configured to be received by the second and third channel portions of the Y-shaped channel of the slider, wherein the width of the first protrusion parallel to the centreline and proximate the centreline is greater than the width of an entrance to the first channel portion of the Y-shaped channel and/or than the width of an entrance to the second channel portion of the Y-shaped channel, and the width of the entrance to the first channel portion and the width of the entrance to second channel portion are in a direction which is parallel to the centreline in the region of the protrusion.

11. The slide fastener according to claim 1, wherein the slider comprises an upper portion connected to a lower portion by a connection post extending in a third direction from the upper portion to the lower portion, wherein the upper portion, the lower portion and the connection post co-operate to define a Y-shaped channel having a first channel portion separated from a second channel portion by the connection post, and a third channel portion which adjoins the first and second channel portions, wherein the coupling portion of the first fastener tape is configured to be received by the first and third channel portions of the Y-shaped channel of the slider, wherein the coupling portion of the second fastener tape is configured to be received by the second and third channel portions of the Y-shaped channel of the slider, wherein entrances to each of the first and second channel portions are located at a front end of the slider opposite a back end of the slider at which an entrance to the third channel portion is located, and wherein the first protrusion extends away from a portion of the slide fastener reinforcing strap adjoining the first protrusion by a distance in the first direction which is greater than a distance between a forward-most tip of the lower portion and the forward-most point at which the connection post adjoins the upper portion.

12. The slide fastener according to claim 1, wherein the slider comprises an upper portion connected to a lower portion by a connection post extending in a third direction from the upper portion to the lower portion, wherein the upper portion, the lower portion and the connection post co-operate to define a Y-shaped channel having a first channel portion separated from a second channel portion by the connection post, and a third channel portion which adjoins the first and second channel portions, wherein the coupling portion of the first fastener tape is configured to be received by the first and third channel portions of the Y-shaped channel of the slider, wherein the coupling portion of the second fastener tape is configured to be received by the second and third channel portions of the Y-shaped channel of the slider, and wherein the first protrusion extends away from a portion of the slide fastener reinforcing strap adjoining the first protrusion by a distance in the first direction which is greater than half a distance in the third direction between the upper portion and the lower portion.

13. The slide fastener according to claim 1, wherein the slide fastener reinforcing strap is located such that a second protrusion extends away from the centreline in the second direction by an amount sufficient to ensure that the second protrusion overlaps the slider when the slider is positioned such that the slider abuts the end stop.

14. The slide fastener according to claim 13, wherein the slide fastener reinforcing strap is located such that a second protrusion extends away from the centreline in the second direction by an amount sufficient to ensure, that when the slider is positioned such that the slider abuts the end stop, the second protrusion overlaps the slider by a distance equal to about a third of the length of the slider parallel to the first sliding direction.

15. The slide fastener according to claim 1, wherein the slide fastener reinforcing strap is located such that the first protrusion extends away from the centreline in the first direction by an amount sufficient to ensure that the first protrusion overlaps the slider when the slider is positioned such that the slider abuts the end stop.

16. The slide fastener according to claim 1, wherein the slide fastener reinforcing strap is located such that a second protrusion extends away from the centreline in the second direction by an amount sufficient to ensure that the second protrusion overlaps the slider when the slider is positioned such that the slider abuts the end stop.

17. The slide fastener according to claim 1, wherein the first end of the slide fastener reinforcing strap is attached to the first fastener tape and the second end of the slide fastener reinforcing strap is attached to the second fastener tape.

18. An article including the slide fastener according to claim 1.

19. An article including a slide fastener, wherein the first fastener tape is attached to a first portion of the article, wherein the second fastener tape is attached to a second portion of the article, and wherein the slide fastener reinforcing strap according to claim 1 is attached to the first and second portions of the article.

20. The article including the slide fastener, according to claim 19, wherein the first end of the slide fastener reinforcing strap is attached to the first portion of the article, and the second end of the slide fastener reinforcing strap is attached to the second portion of the article, wherein the first fastener tape is located between the first portion of the article and the second fastener tape, and wherein the second fastener tape is located between the second portion of the article and the first fastener tape.

* * * * *